US010875074B2

(12) United States Patent
Lam et al.

(10) Patent No.: US 10,875,074 B2
(45) Date of Patent: Dec. 29, 2020

(54) DIE MECHANISM, APPARATUS, AND METHOD FOR SHAPING A COMPONENT FOR CREEP-AGE FORMING

(71) Applicant: AVIC Beijing Aeronautical Manufacturing Technology Research Institute, Beijing (CN)

(72) Inventors: Aaron C. L. Lam, London (GB); Zhusheng Shi, London (GB); Xia Huang, Beijing (CN); Yuansong Zeng, Beijing (CN); Zhiqiang Li, Beijing (CN); Jianguo Lin, London (GB)

(73) Assignee: AVIC Beijing Aeronautical Manufacturing Technology Research Institute, Beijing (CN)

( * ) Notice: Subject to any disclaimer, the term of this patent is extended or adjusted under 35 U.S.C. 154(b) by 509 days.

(21) Appl. No.: 15/551,946

(22) PCT Filed: Feb. 18, 2016

(86) PCT No.: PCT/GB2016/050407
§ 371 (c)(1),
(2) Date: Aug. 18, 2017

(87) PCT Pub. No.: WO2016/132135
PCT Pub. Date: Aug. 25, 2016

(65) Prior Publication Data

US 2018/0065166 A1 Mar. 8, 2018

(30) Foreign Application Priority Data

Feb. 18, 2015 (GB) ..... 1502734.5

(51) Int. Cl.
*B21D 37/02* (2006.01)
*B21D 22/02* (2006.01)

(52) U.S. Cl.
CPC ..... *B21D 37/02* (2013.01); *B21D 22/022* (2013.01)

(58) Field of Classification Search
CPC ..... B21D 37/02; B21D 22/022; B21D 11/00; B21D 11/02; B21D 31/005
(Continued)

(56) References Cited

U.S. PATENT DOCUMENTS 2,334,520 A 11/1943 Walters
2,446,487 A * 8/1948 O'Kelley ..... B21D 1/12 72/413

(Continued)

FOREIGN PATENT DOCUMENTS

CN 101774274 7/2010
CN 102266887 12/2011

(Continued)

OTHER PUBLICATIONS

International Preliminary Report on Patentability dated Aug. 31, 2017 From the International Bureau of WIPO Re. Application No. PCT/GB2016/050407. (5 Pages).

(Continued)

*Primary Examiner* — Teresa M Ekiert

(57) ABSTRACT

A die mechanism comprises a first support member and a second support member, the first and second support members extending in a first direction; a plurality of pin modules between the first and second support members, wherein each of the plurality of pin modules extends in a second direction perpendicular to the first direction, and each pin module comprises a plurality of pins; wherein heights of ends of the plurality of pins within each of the plurality of pin modules together define a shape profile for shaping the component during creep-age forming; and wherein: the plurality of pin modules are configured to be movable along the first and (Continued)

second support members in the first direction, and/or the plurality of pins are configured to be movable along respective pin modules in the second direction.

11 Claims, 5 Drawing Sheets

(58) Field of Classification Search
USPC ..... 72/475
See application file for complete search history.

(56) References Cited

U.S. PATENT DOCUMENTS

| | | | | |
|---|---|---|---|---|
| 3,745,805 | A | 7/1973 | Gauthier | |
| 3,889,513 | A | 6/1975 | Iwasaki et al. | |
| 4,212,188 | A | 7/1980 | Pinson | |
| 4,894,903 | A | 1/1990 | Woods | |
| 5,187,969 | A * | 2/1993 | Morita | B21D 53/886 72/413 |
| 5,913,929 | A | 6/1999 | Gustafsson et al. | |
| 5,954,175 | A * | 9/1999 | Haas | B21D 37/02 192/48.2 |
| 6,053,026 | A | 4/2000 | Nardiello et al. | |
| 6,089,061 | A | 7/2000 | Haas et al. | |
| 6,209,380 | B1 * | 4/2001 | Papazian | B21D 37/02 72/413 |
| 6,264,771 | B1 | 7/2001 | Bornschlegl et al. | |
| 6,298,896 | B1 | 10/2001 | Sherrill et al. | |
| 2007/0107189 | A1 | 5/2007 | Prichard et al. | |
| 2014/0366600 | A1 | 12/2014 | Kozaki et al. | |

FOREIGN PATENT DOCUMENTS

| | | |
|---|---|---|
| CN | 102284589 | 12/2011 |
| EP | 0448339 | 9/1991 |
| EP | 0570212 | 11/1993 |
| EP | 0507033 | 2/1995 |
| WO | WO 2004/054735 | 7/2004 |
| WO | WO 2014/199928 | 12/2014 |

OTHER PUBLICATIONS

International Search Report and the Written Opinion dated May 2, 2016 From the International Searching Authority Re. Application No. PCT/GB2016/050407. (13 Pages).

Notification of Office Action and Search Report dated Nov. 1, 2018 From the State Intellectual Property Office of the People's Republic of China Re. Application No. 201680022608.1 and Its Translation of Office Action Into English. (17 Pages).

Patents Act 1977: Search Report Under Section 17(5) dated Jul. 24, 2015 From the Intellectual Property Office of the United Kingdom of Great Britain Re. Application No. GB1502734.5. (8 Pages).

Patents Act 1977: Search Report Under Section 17(6) dated Mar. 21, 2016 From the Intellectual Property Office of the United Kingdom of Great Britain Re. Application No. GB1502734.5. (2 Pages).

Translation of Notification of Office Action dated Aug. 26, 2019 From the China National Intellectual Property Administration Re. Application No. 201680022608.1. (13 Pages).

* cited by examiner

DIE MECHANISM, APPARATUS, AND METHOD FOR SHAPING A COMPONENT FOR CREEP-AGE FORMING

RELATED APPLICATIONS

This application is a National Phase of PCT Patent Application No. PCT/GB2016/050407 having International filing date of Feb. 18, 2016, which claims the benefit of priority of United Kingdom Patent Application No. 1502734.5 filed on Feb. 18, 2015. The contents of the above applications are all incorporated by reference as if fully set forth herein in their entirety.

FIELD AND BACKGROUND OF THE INVENTION

The present invention relates to a die mechanism and an apparatus for shaping a metallic component for a creep-age forming (CAF) process, and in particular, but not exclusively for shaping a metallic component so that it adopts a desired shape for creep-age forming. The present invention also relates to a method for adjusting a die mechanism for a creep-age forming process.

Shaping components such as commercial aircraft wing skins is a complex operation because the structures, dimensions, and shapes of aircraft wings need to be carefully designed and determined according to various factors, including the payload requirements and purposes of the particular aircrafts which employ them. Creep-age forming (CAF) has been employed as a metal forming technique in the aerospace and aircraft industries for forming large integrally stiffened panels with complex curvature and abruptly changing thickness, such as wing skins and stringers.

One of the reasons why CAF process are preferred over other processes is that components manufactured by CAF require a low forming stress and contain low residual stress which enhance fatigue resistance and improve the strength-to-weight ratio of the final product. CAF process is a combined process of stress relaxation and age hardening, and the synchronous occurrence of these two phenomena reduces on-going manufacturing costs significantly. In addition, CAF is also an alternative for shot peen forming which is labour intensive and has an adverse impact to the environment due to the generation of dust and noise.

CAF has been adopted in the industry of manufacturing aircraft wing components by a number of aircraft manufacturers for the benefits mentioned above. However, there are a number of issues associated with CAF processes.

Firstly, the costs for forming large aircraft wing panels are high since wings or different aircrafts have different aerofoil, each with their own complex requirements that are exclusive to a particular aircraft model. Specific tooling needs to be developed and built for each new wing design. The development of new tooling for each new aircraft wing design commonly exceeds many millions of dollars. Also, maintenance costs of the tool will also add onto the production lifespan for the aircraft.

Secondly, there is a need to compensate for springback of creep-age formed parts, which requires expensive and time-consuming shape rectification of conventional tools. Springback is a result of residual elastic stresses in a creep-age formed part which causes the part to spring back towards an original shape after being released from the forces of the forming tool. The economic impact of delayed production and tooling revision costs due to springback is huge and it is an even bigger problem when translated to CAF, as springback of creep-age formed parts can reach up to 80%. The abruptly changing thickness of wing panels also makes it more difficult to accurately predict the extent of springback, which leads to necessary modification of the tool shape during trial.

Modifying the tool shape of conventional solid matched dies not only requires expensive precision apparatus and long hours of machining, large amount of waste material is also generated as a result. Furthermore, solid dies are heavy in weight which makes maintenance and handling of the tool difficult.

In view of the above, it is an objective of the present invention to provide a die mechanism and an apparatus which overcome the disadvantages of the conventional systems and devices.

SUMMARY OF THE INVENTION

It is an object of the invention to provide an apparatus and a method which substantially alleviates or overcomes the problems mentioned above.

According to an aspect of the present invention, there is provided a die mechanism for shaping a component during creep-age forming, the die mechanism comprising: a first support member and a second support member, the first and second support members extending in a first direction; a plurality of pin modules between the first and second support members, wherein each of the plurality of pin modules extends in a second direction perpendicular to the first direction, and each pin module comprises a plurality of pins; wherein heights of ends of the plurality of pins within each of the plurality of pin modules together define a shape profile for shaping the component during creep-age forming; and wherein: the plurality of pin modules are configured to be movable along the first and second support members in the first direction, and/or the plurality of pins are configured to be movable along respective pin modules in the second direction.

Some of the embodiments of the present invention can provide flexibility by allowing the positions of the pins and/or pin modules to be adjusted, and/or the heights of the pins within the pin modules to be adjusted. This flexibility can eliminate the need for manufacturing a unique forming tool for each shape required. Hence, the lead time can be reduced, and the maintenance and manufacturing costs that are associated with additional tool designs may be eliminated.

Some embodiments of the present invention provide can adaptability by allowing pin modules and/or pins to be added or removed to define controlling points, based on a certain desired shape, without having to make any alternations to the structures of the rest of the die mechanism.

Some embodiments of the present invention can provide modularity by making use of standard removable parts (e.g. the pins and/or the pin modules) across the die mechanism, therefore reducing the initial cost for manufacturing the die mechanism. In addition, in cases where individual parts of the die mechanism of such embodiments become damaged or worn, the replacement cost is low as the standard parts can be reproduced individually without replacing the rest of the parts of the apparatus. Moreover, as a result of the modularity, the die mechanism of some embodiments of the present invention may be applicable for the production of components of variable sizes.

Some embodiments of the present invention can allow fewer pins to be used for defining a particular desired shape profile. Therefore, the die mechanism is more lightweight than conventional tools and can be easily transported.

The heights of the plurality of pins within each pin module may be adjustable.

The plurality of pin modules may be configured to be removable from the first and second support members.

The plurality of pins of each pin module may be configured to be removable from the pin module.

Each of the plurality of pins of each pin module may be housed in a pin housing.

The plurality of pin housings of each pin module may be configured to be movable along a length of the pin module in the second direction.

Each of the plurality of pin modules may comprise a first module rack and a second module rack positioned adjacent to each other and extending in the second direction, between which the plurality of pin housings are engaged, further wherein each of the first and second module racks may comprise an inward-facing guiding member arranged to guide the movement of the plurality of pin housings along the length of the pin module in the second direction.

The plurality of pin housings of each pin module may be configured to be removable from the pin module.

Each pin module may comprise a shaping member attached to ends of the pins of the pin module, each shaping member arranged to adopt a shape profile defined by the heights of ends of the pins of the pin module.

The plurality of shaping members may be made of a metallic material that is capable of deforming elastically to adopt the shape profile defined by the heights of ends of the pins of the pin module.

The shaping member of each pin module may be magnetically attached to the ends of the pins of the pin module.

According to another aspect of the present invention, there is provided a die mechanism for shaping a component during creep-age forming, the die mechanism comprising a first support member and a second support member, the first and second support members extending in a first direction; a plurality of pin modules between the first and second support members, wherein each of the plurality of pin modules extends in a second direction perpendicular to the first direction, wherein each pin module comprises: a plurality of pins, wherein heights of the plurality of pins within each pin module are adjustable, and heights of ends of the plurality of pins within each of the plurality of pin modules together define a shape profile for shaping the component during creep-age forming, and a shaping member attached to ends of the pins of the pin module, the shaping member arranged to adopt the defined shape profile.

The plurality of pin modules may be configured to be movable along the first and second support members in the first direction.

The plurality of pins of each pin module may be configured to be movable along the pin module in the second direction.

The plurality of pin modules may be fixed to the first and second support member.

The plurality of pins of each pin module may be fixed to the pin module.

According to another aspect of the present invention, there is provided an apparatus for shaping a component during creep-age forming comprising a first die mechanism and a second die mechanism as set out in claim 17.

The top and bottom die may comprise a same number of pins, and a position of each pin within the top die is vertically aligned with a position of a corresponding pin within the bottom die.

According to another aspect of the present invention, there is provided a method for adjusting a die mechanism of any one of claims 1 to 16 for shaping a component for creep-age forming, the method comprising the steps of: determining heights and positions of each of the plurality of pins within each said pin module and the position of each pin module along the first and second support members, such that the positions and heights of the plurality of pins define a shape profile defining a desired shape for shaping a component; adjusting at least one of: the heights of each of the plurality of pins within each pin module, the positions of the plurality of pins within each pin module, and the positions of the plurality of pin modules along the first and second support members, according to the determination.

These and other aspects of the invention will be apparent from and elucidated with reference to the embodiments described hereinafter.

BRIEF DESCRIPTION OF THE SEVERAL VIEW OF THE DRAWINGS

Embodiments of the invention will now be described, by way of example only, with reference to the accompanying drawings, in which.

Reference will now be made in detail to the embodiments of the present invention, examples of which are illustrated in the accompanying drawings, wherein like reference numerals refer to like elements throughout.

DESCRIPTION OF SPECIFIC EMBODIMENTS OF THE INVENTION

The accompanying drawings in FIGS. 1 to 4 illustrate the structure and assembly of an apparatus and a die mechanism for shaping a wing skin of an aircraft for creep-age forming, according to a first embodiment of the present invention.

Figure 1:
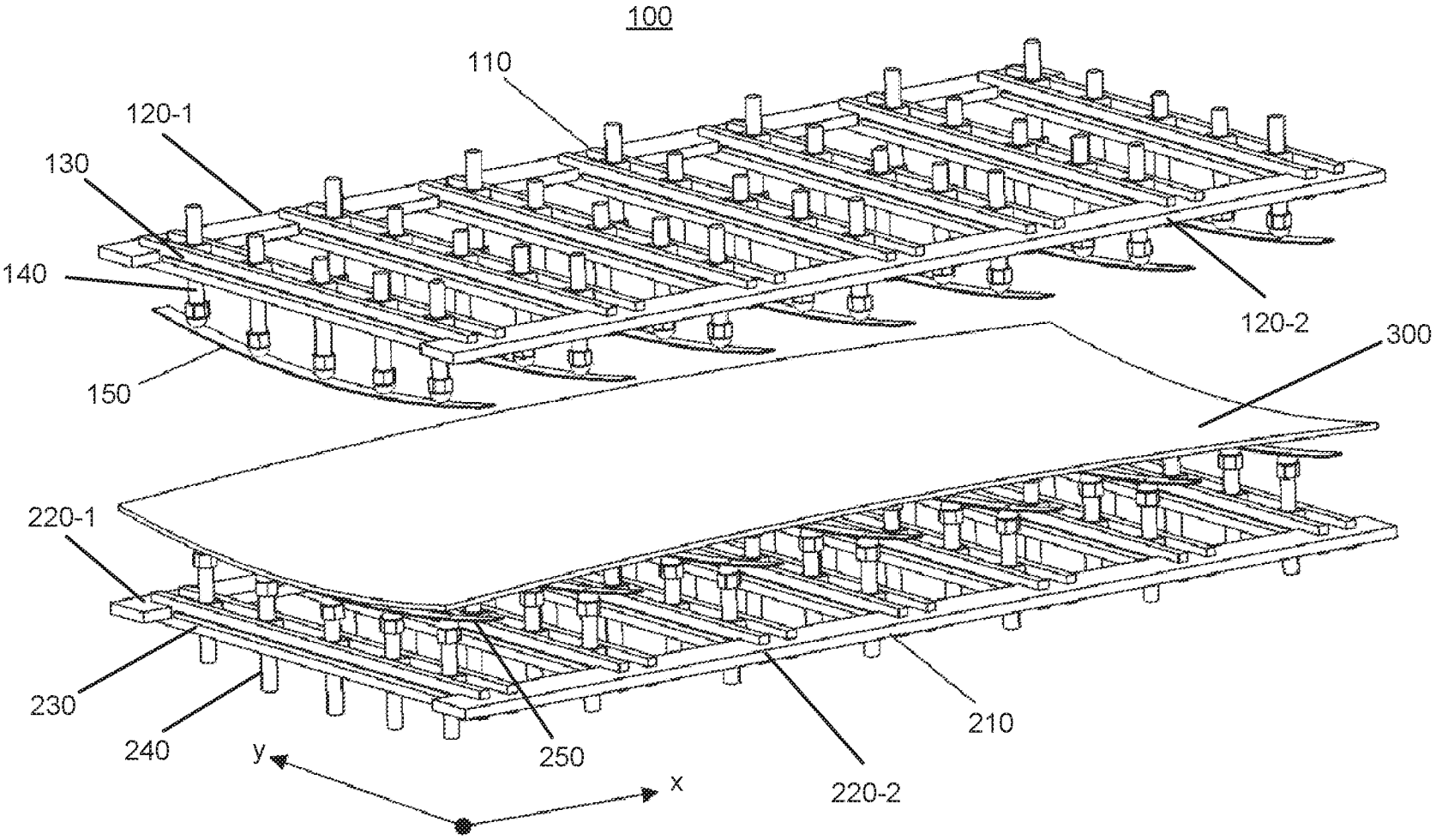
FIG. 1 is the present invention according to a first embodiment.

FIG. 1 is the present invention according to a first embodiment. Specifically, FIG. 1 shows an apparatus 100 comprising a first die mechanism 110 and a second die mechanism 210, the first and second die mechanisms 110, 210 having the same overall structural arrangement.

In use, an aircraft wing skin component 300 to undergo creep-age forming is placed between the first die mechanism 110 and the second die mechanism 220 as illustrated in FIG. 1. In this embodiment, the x-direction corresponds to the span direction and the y-direction corresponds to the chord direction. As shown in FIG. 1, the x-direction and the y-direction are perpendicular to each other.

The first die mechanism 110 comprises a first support member 120-1, a second support member 120-2, and a plurality of pin modules 130 located between the first and second support members 120. The first and second support members in this embodiment have a rail shape that longitudinally extends in a first direction (x-direction), and they are arranged in parallel so as to accommodate the plurality of pin modules 130.

The second die mechanism 210 comprises a third support member 220-1, a fourth support member 220-2, and a plurality of pin modules 230 located between the third and fourth support members 220. The third and fourth support members in this embodiment also have a rail shape that longitudinally extends in the first direction (x-direction), and they are arranged in parallel so as to accommodate the plurality of pin modules 230.

In the present embodiment, the first and second support members no are rigidly fixed to a first base (not illustrated in the drawings), and the third and fourth support members 210 are rigidly fixed to a second base (not illustrated in the drawings). In the present embodiment, the support members 110, 210 are respectively fixed to the first and second bases by welding. The support members 120, 220 are arranged within the apparatus 100 such that the plurality of pin modules 130, 230 can be added and removed from between the respective support members in a sliding manner.

Each pin module 130, 230 extends longitudinally in a second direction (y-direction). The pin modules 130 of the first die mechanism 110 are configured to be movable along the lengths of the support members 120 in the x-direction. Similarly, the pin modules 230 of the second die mechanism 210 configured to be movable along the lengths of the support members 220 in the x-direction. In particular, in this embodiment, the pin modules 130, 230 are configured to be slidable along the length of the respective support members 120, 220 in the x-direction.

Once the pin modules 130, 230 are adjusted to their respective desired positions for achieving a desired profile shape for shaping the component 300, they can be temporarily fixed to the respective support members 120, 220 by means of a locking means in order to prevent them from being moved away from the desired positions during the CAF process.

In this embodiment, the locking means is a nut and bolt (not illustrated in the drawings) provided at each end of the plurality of pin modules 130, 230 for allowing the pin module 130, 230 to be bolted onto the respective support members 120, 220.

Figure 2:
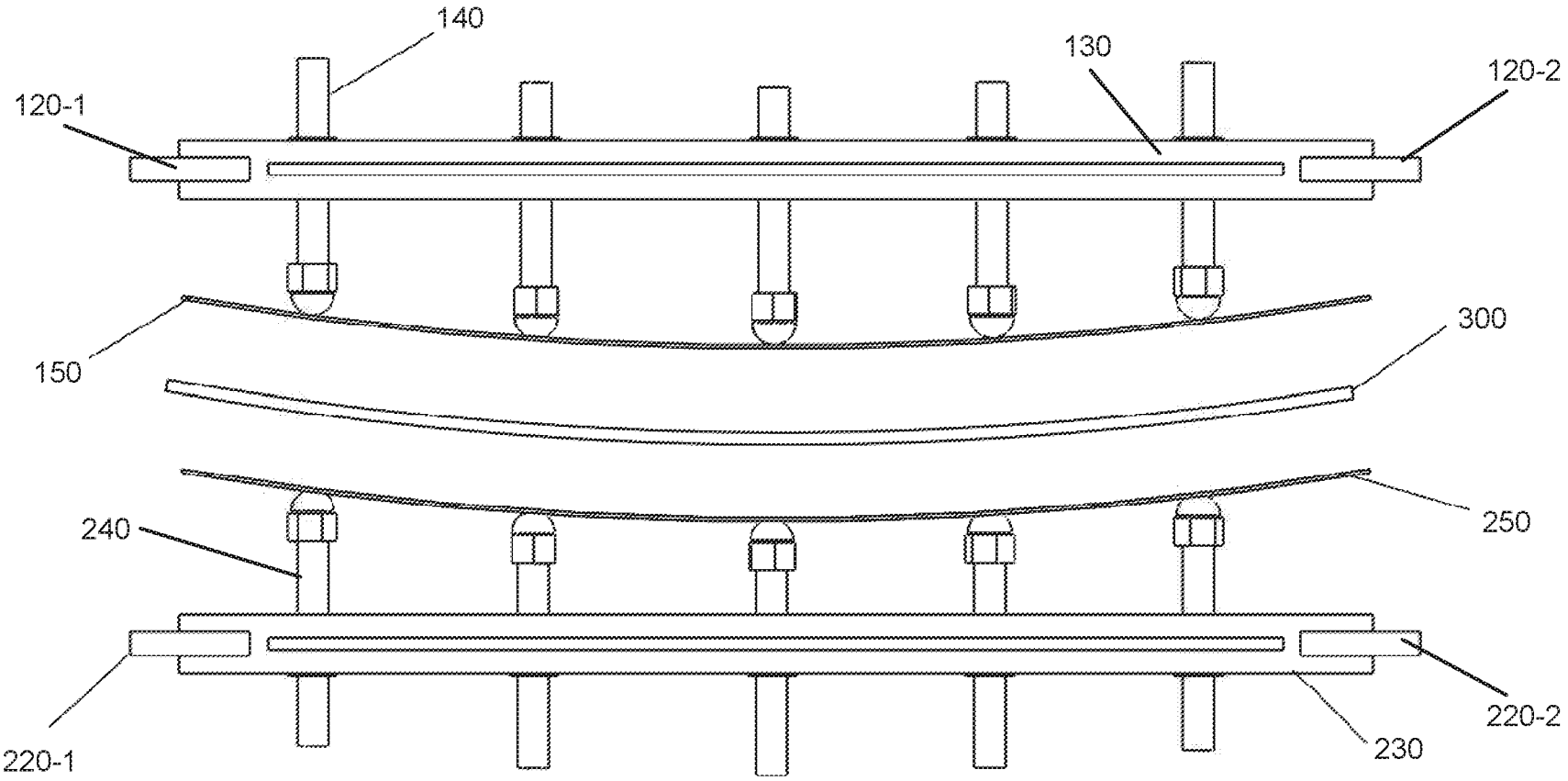
FIG. 2 is a view of the cross-section of the apparatus of FIG. 1 along the y-direction.

Each pin module 130, 230 of the present embodiment as shown in FIGS. 1 and 2 comprises 5 pins 140, 240 which are arranged along the length of the pin module 130, 230 (i.e. the y-direction). In the present embodiment, the pins 140, 240 are made of tool steel. The heights of the pins 140, 240 within the pin modules 130, 230 are adjustable.

The arrangement of the pins 140, 240 along the pin module 130, 230 and their heights within the pin modules 130, 230 are based on the desired curvature and shape of a shape profile for shaping the component 300. This is illustrated in FIG. 2, which is a view of the cross-section of the apparatus 100 of FIG. 1 along the y-direction. Since the positions and the heights of the pins 140, 240 within the pin modules 130, 230 can be adjusted, there is no need to manufacture a new forming tool for each new desired shape for forming the component 300.

In this embodiment, the pins 140, 240 are arranged to be removable from the pin modules 130, 230. Therefore, it would be possible to remove a pin 140 from the pin module 130 of the first die mechanism 110, and install that pin in the pin module 240 of the second die mechanism 210.

The pins 140 of the first die mechanism 110 are arranged such that they point downwards and the pins 240 of the second die mechanism 210 are arranged such that they point upwards in use. Also, the positions of the plurality of pins 140 of the first die mechanism 110 and the positions of the plurality of pins 240 of the second die mechanism 240 are vertically aligned. This is clearly illustrated in the cross-section view in FIG. 2. The details of the assembly of the pins 140, 240 in the pin modules 130, 230 will be explained in further detail in relation to FIG. 3.

In this embodiment, once the pins 140, 240 are adjusted to the required positions and heights within the pin module 130, 230 for achieving the desired shape profile, they are fixed in place. The heights of the ends of the pins 140, 240 define the shape profile, which is to be adopted by shaping members 150, 250 attached to the pins 140, 240, as will be explained in the following.

As shown in FIGS. 1 and 2, each pin module 130, 230 further comprises a shaping member 150, 250 attached to the ends of the pins 140, 150 of the same pin module 130, 230. By attaching a shaping member 150, 250 to the ends of the pins, a same shape profile can be maintained for shaping a component 300 with fewer pins, hence reducing material costs as well as the weight of the die mechanism.

In other words, the use of shaping members 150, 250 in the die mechanism 110, 210 allows larger spacing between adjacent pins within a pin module. The optimal amount of spacing between adjacent pins may be determined (e.g. by analytical and/or numerical calculations) based on a number of factors, including material and/or mechanical properties of the material, the creep-ageing behaviour of the component 300, the desired shape for forming the component 300 (including local and overall curvatures of the shape that is required across all area of the component 300), number of controlling points required for the desired shape, the mechanics of plate bending and/or beam bending under certain boundary conditions (e.g. using calculations), and the difference in heights between the adjacent pins. As an example, a larger spacing can be arranged between two adjacent pins if they have a small difference in heights within the pin module.

As illustrated in FIG. 2, in the present embodiment the positions and the heights of the pins 140 of the first die mechanism 110 are arranged such that they correspond to the positions and the heights of the pins 240 of the second die mechanism 210. In other words, the shape profile defined by the ends of the pins 140 of the first die mechanism 110 is substantially the same that defined by the ends of the pins 240 of the second die mechanism 210. In other words, the heights of the pins 140 of the first die mechanism 110 are opposite to those of the corresponding pins 240 of the second die mechanism 210.

In the present embodiment, the ends of the plurality of pins 140, 240 are made of magnetic material, and the shaping member 150, 250 of each pin module 130, 230 is magnetically attached to the pins 140, 240 at the ends of the plurality of pins 140, 240 in the pin module 130, 230. This attachment method allows the shaping members 150, 250 to slide in the y-direction over the ends of the pins 140, 240 but do not detach in other directions. This attachment method also allows the shaping members 150, 250 to be removable from the plurality of pins 140, 240 if needed.

In this embodiment, the shaping members 150, 250 are made of high-strength steel, and they are capable of deforming elastically in order to adopt a shape profile defined by the ends of the pins of the respective pin module. The shape and curvature of each shaping member 150, 250 are controlled by adjusting the heights of the pins 140, 240 in the respective pin module 130, 230 along the y-direction. The desired shape and curvature of each shaping member 150, 250 are determined according to the specific shape control requirements for forming the component 300.

In this embodiment, once the pins 140, 240 and the pin modules 130, 230 are adjusted to their required positions, only the heights of the pins 240 of the second die mechanism 210 are rigidly fixed to the pin modules 230. The heights of the pins 140 in the first die mechanism 110 are less rigidly fixed once they are adjusted to their required positions, such that they allow a small amount of height readjustment once the shaping members 150, 250 and the component 300 are in contact. This ensures a maximum contact between the shaping members 150, 250 and the component 300, and therefore reduced errors in the CAF process.

In the present embodiment, when the first die mechanism 110 is lowered towards the second die mechanism 210 before the CAF process begins, the component 300 placed between the shaping member 150 of the first die mechanism 110 and the shaping member 250 of the second die mechanism 210 would be subject to a load from the first die mechanism 110. The shaping members 150, 250 deform in a way that can be predicted with a combined knowledge in the material behaviour of the component 300 as well as the mechanics of beam bending, plate bending, and sheet metal forming.

In the present invention, the support members 120, 220, the pin modules 130, 230, the pins 140, 240, and the first and second bases (not illustrated in the drawings) are made of tool steel, and together they form a rigid supporting structure. These units of the apparatus 100 are made of material or materials that are substantially stiff and undergo negligible deformation during a CAF process.

Figure 3:
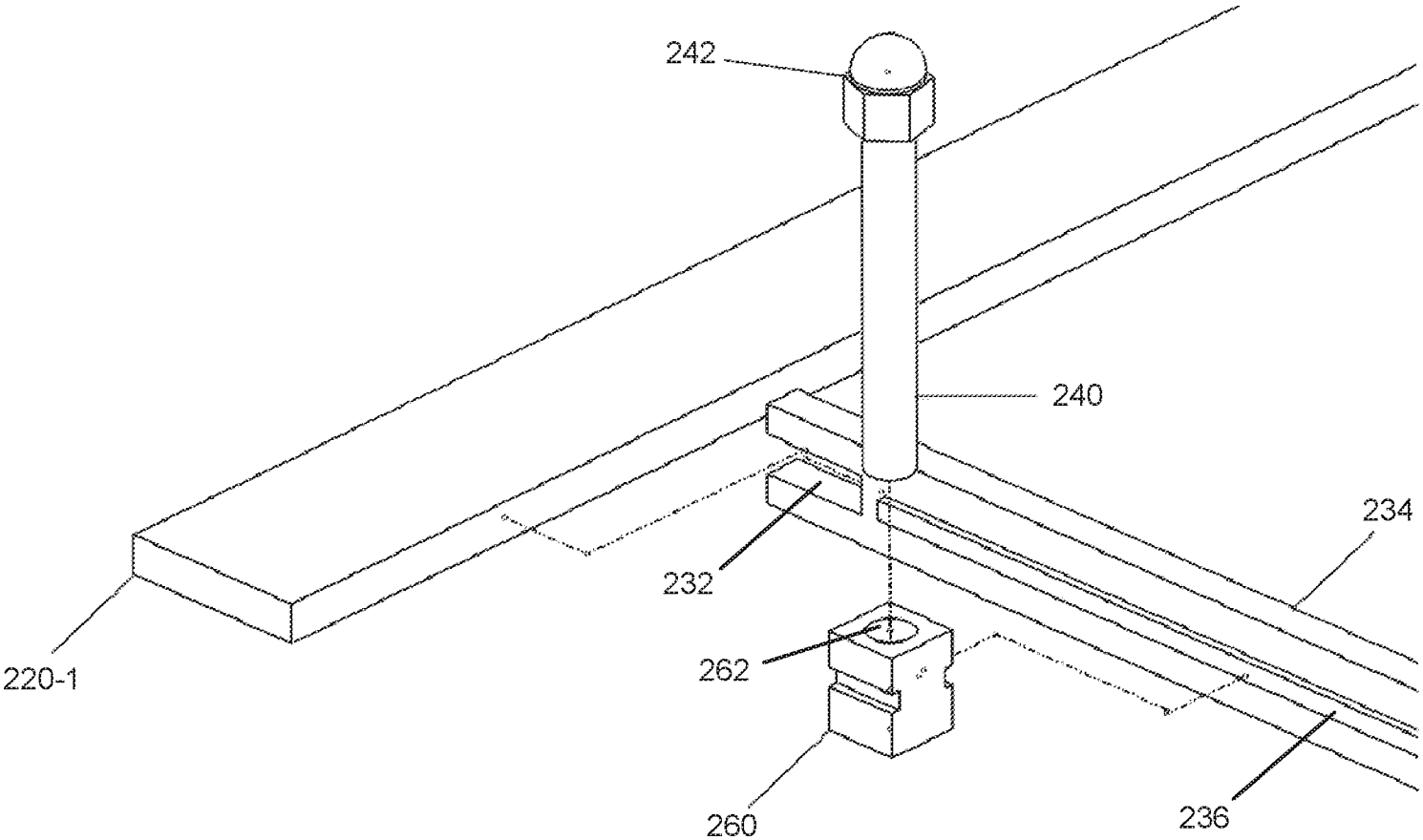
FIG. 3 is an exploded view which illustrates the assembly of a die mechanism according to the first embodiment of the present invention.

FIG. 3 is an exploded view which illustrates the assembly of a die mechanism according to the first embodiment of the present invention. Specifically, FIG. 3 shows the structural relationship between a pin 240, a pin housing 260, and a pin module 230 in the second die mechanism 210.

In the present embodiment, each pin module 230 comprises two module racks 234 which extend longitudinally in the y-direction in parallel. A single module rack 234 is shown in FIG. 3 in order to illustrate the structural relationship between a pin 240, a pin housing 260, and one of the module racks 234. Although not shown in the drawing, the pin 240 and the pin housing 260 have the same structural relationship with the other module rack in the same pin module 230 when the die mechanism 210 is fully assembled.

As shown FIG. 3, a groove 232 is provided at an end of the module rack 234 which allows the module rack 234 to be movable along the third support member 220-1, such that the pin module 230 as a whole is movable along the third support member 220-1 in a sliding manner in the x-direction. Similarly, a groove is also provided at the other end (not shown in the drawing) of the module rack 234 which allows the module rack to be movable along the fourth support member 220-2 such that the pin module 230 as a whole is movable along the fourth support member 220-2 in a sliding manner in the x-direction.

A guiding member 236 in the form of a flange is provided on a side of the module rack 234 in order to engage a groove provided at the side of the pin housing 260. Another groove is provided on the opposite side of the pin housing in order to engage a guiding member (also in the form of a flange) provided on another module rack (not shown in the drawing). When fully assembled, the pin housing 260 is movable along the length of the module racks 234 in a sliding manner in the y-direction.

Once the pin housings 260 are adjusted to their respective desired positions, they can be temporarily rigidly fixed to the module racks of the pin module by tightening the space between the two module racks 234 (e.g. by pushing the module racks together).

A through-hole 262 is provided at the pin housing 260 through which the pin 240 can be inserted and secured at a desired height. In this embodiment, the inner surface of the through-hole 262 and a body of the pin 240 have complementing screw-thread arrangement. This arrangement allows the pin 240 to be securely fastened to the pin housing 260. Also, this arrangement allows the height of the pin 240 in relation to the pin housing 260 to be adjusted by rotation.

Figure 4:
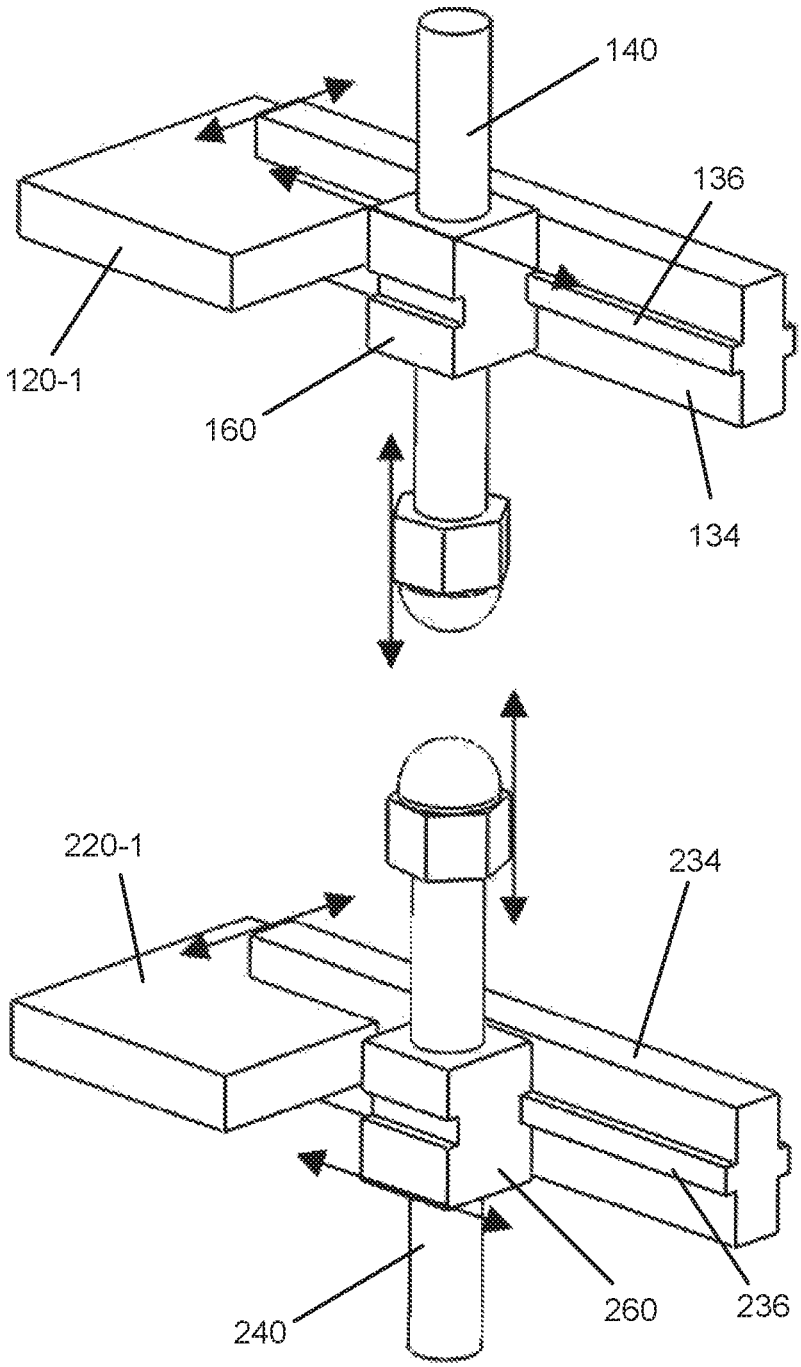
FIG. 4 is a schematic view which illustrates the possible relative movements of the elements of the apparatus according to the first embodiment of the present invention.

FIG. 4 is a schematic view which illustrates the possible relative movements of the elements of the apparatus according to the first embodiment of the present invention. The first support member 120-1, the module rack 134, and the pin housing 160 holding the pin 140 of the first die mechanism 110 are shown in an assembled configuration. Similarly, the third support member 220-1, the module rack 234, and the pin housing 260 holding the pin 240 of the second die mechanism 210 are shown in an assembled configuration.

The possible relative movements between the third support member 220-1, the module rack 234, the pin housing 260, and the pin 240 are identical to those for the corresponding elements of the first die mechanism 110 as described above. For the sake of brevity, only the relative movements of the elements in the first die mechanism 110 will be described in detail hereinafter.

As shown in FIG. 4, when assembled in the first die mechanism 110, the module rack 134 can be moved along the length of the first support member 120-1 shown by first double-ended arrow in the drawing, i.e. in the x-direction. A groove at a side of the pin housing 160 is engaged with a guiding member 136 of the module rack 134 such that the pin housing 160 can be moved along the length of the module rack 134 as shown by a second double-ended arrow, i.e. in the y-direction. The pin 140 is inserted through a through-hole provided at the pin housing 160 and it can be moved upwards and downwards (i.e. orthogonal to the x-direction and the y-direction), shown by a third double-ended arrow in the drawing.

Although it is described in relation to FIGS. 1 and 2 that the apparatus 100 comprises both the first die mechanism 110 and the second die mechanism 210, in alternative embodiments the apparatus 100 may only comprise only one of the first and second die mechanisms. In an alternative embodiment in which only a single die mechanism is used in the apparatus, other techniques, e.g., vacuum bagging, may be used in the CAF process in which the upper surface of the component 300 is subjected to a uniformly distributed pressure load.

In alternative embodiments, instead of tool steel, the support members 120, 220, the pin modules 130, 230, the pins 140, 240, and the first and second bases may be made of other suitable material or materials to form a rigid supporting structure.

In alternative embodiments, the support members 110, 210 may be rigidly fixed to the first and second bases respectively by other means, for example, a mechanical fixing means, such as a clamp.

In alternative embodiments, the pins 140, 240 of the first die mechanism 110 and the second die mechanism 210 may be arranged in other configurations, according to a number of factors such as a desired shape profile and the material of the component 300 being shaped.

In alternative embodiments, the pins 140, 240 may be made of other suitable material or materials, according to the requirements for shaping the component in the CAF process.

In alternative embodiments, instead of using a nut and bolt, the pin modules 130, 230 may be temporarily fixed to the respective support members 120, 220 using other locking means, such as a clamp.

In alternative embodiments, at least some of the pin modules 130, 230 may be arranged to be fixed to the respective supporting members 220, 230 permanently by a fixing means, such that they are not movable within the die mechanisms 110, 210 and not removable from the die mechanism 110, 210. In these alternative embodiments, the pin modules 130, 230 may be formed integrally with the supporting members 120, 220.

In alternative embodiments, at least some of the pins 140, 240 may be arranged to be fixed permanently to the respective pin modules 130, 230 by a fixing means, such that they are not movable within the pin module 130, 230 and not removable from the pin module 130, 230. In these alternative embodiments, the pins 140, 240 may be formed integrally with the pin modules 130, 230. In alternative embodiments where the plurality of pins 140, 240 are fixed to the pin modules 130, 230, the spacing between the pins may be uniform and/or predetermined according to a desired shape profile.

In alternative embodiments, at least some of the pin housings 160, 260 may be arranged to be fixed permanently to the respective pin modules 130, 230 by a fixing means, such that they are not movable within the pin module 130, 230 and not removable from the pin module 130, 230. In these alternative embodiments, the pin housings 160, 260 may be formed integrally with the pin modules 130, 230.

In alternative embodiments, other suitable means and/or configuration may be used for the engagement between the pin 240 and the pin housing 260, between the pin housing 260 and the module rack 234, and between the module rack 234 and the third support member 220-1. For example, a flange may be provided on the pin housing 260 so as to engage with a guiding member (e.g. in the form of a groove) provided at the module rack 234 such that the pin housing 260 is movable along the length of the module rack 234. It should be apparent to the skilled person in the art that a variety of other engaging members may be used for the same purposes.

In alternative embodiments, other suitable locking mechanisms may be provided for rigidly fixing the pin housings 160, 260 in place within the respective pin modules 130, 230.

In alternative embodiments, each pin module 130, 230 may comprise a different number of pins 140, 240, depending on a desired shape profile for shaping a component. For example, in such alternative embodiments, a first pin module in a die mechanism may comprise 6 pins, a second pin module in the die mechanism may comprise 3 pins, while a third pin module in the die mechanism may comprise 5 pins.

In alternative embodiments, the plurality of pins 140, 240 of the pin modules 130, 230 may not be height-adjustable. Instead, removable pins of different heights may be installed in the pin modules in order to define the desired shape profile.

In alternative embodiments, instead of high-strength steel, the shaping members 150, 250 may be made of any suitable elastic metallic material with yield strength sufficiently high to prevent it from deforming plastically at all times. In alternative embodiments where the material of the shaping members 150, 250 is not magnetic, the shaping members 150, 250 may be attached to the pins 140, 240 by other suitable techniques.

In addition, in other alternative embodiments of the present invention, it is possible to use the apparatus 100 assembly without any shaping members 150, 250. In these embodiments, instead of the shaping members, the ends of the pins 140, 240 provided at the apparatus are used to deform the component 300 and hold it in place during the heat treatment cycle of the CAF process.

Although it is described that each pin modules 130, 230 comprises two module racks 134, 234, in alternative embodiments, the pin module 130, 230 may comprise a single element, e.g. an integral module rack, the module rack being capable of accommodating a plurality of pins 140, 240 as well as being movable along the support members 120, 220.

Although it is described that the apparatus 100 and the die mechanisms 110, 210 are used in the CAF process for shaping metal aircraft wing skin panels, in alternative embodiments they may be used in the CAF process for any components whose final design properties require material in an artificially aged temper (high tensile strength). Examples of these include aircraft fuselage panels and isogrid constructions for space launch vehicles. Moreover, the apparatus 100 and the die mechanisms 110, 210 may also be used in creep forming processes for shaping sheet metal in alternative embodiments.

Figure 5:
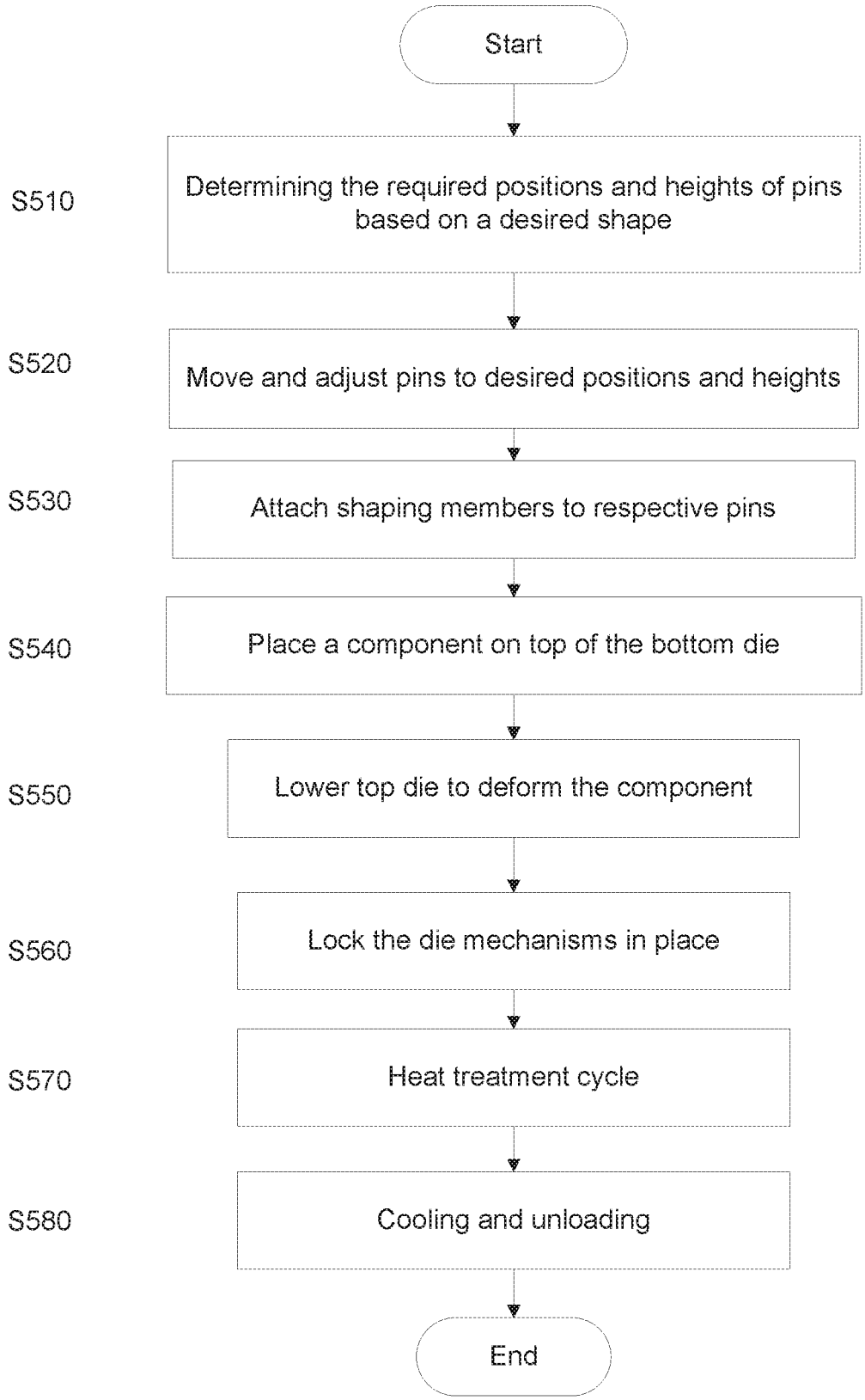
FIG. 5 is a flowchart illustrating a method of adjusting the apparatus and performing creep-age forming using the apparatus according to the first embodiment of the present invention.

FIG. 5 is a flowchart illustrating a method of adjusting the apparatus and performing creep-age forming using the apparatus 100 according to the first embodiment of the present invention.

The process starts at step S510, in which a desired shape for shaping an aircraft wing skin component 300 is determined or provided. In this embodiment, the aircraft wing skin component 300 is made of aluminium alloy. The determination of the desired shape is based on factors including the desired aerofoil and dimensions of the final creep-age formed component 300. The required positions and heights of the plurality of pins 140, 240 within the apparatus 100 for achieving this particular desired shape is then determined using specific shape control requirements for creep-age forming, which takes into account of the material characteristics of the component 300.

In step S520, the pins 140, 240 of the first and second die mechanisms 110, 210 are moved to their respective desired positions and adjusted to the desired heights, according to the results of the determination in step S510.

After that, in step S530, shaping members 150, 250 with selected thicknesses are attached to the ends of the respective pins 140, 240 in the first die mechanism 110 and the second die mechanism 210. As explained above in relation to FIGS. 1 and 2, the shaping members 150, 250 are made of suitable metallic material that allows them to be capable of being elastically deformed.

As shown in FIG. 4, the pins 140 can be moved along the length of the pin modules along a flange provided at the module rack 134 in the y-direction. Also, the height of the pin 140 relative to the pin module can be adjusted in the way illustrated in FIG. 4. If required, the positions of the pins 140 and 240 may also be adjusted by moving the pin modules along the support members 120, 220 of the die mechanisms in the x-direction.

In the present embodiment, once the pins 140, 240 and the pin modules 130, 230 are adjusted to their required positions, only the heights of the pins 240 in the second die mechanism 210 are rigidly fixed in relation to the pin modules 230. The heights of the pins 140 in the first die mechanism 110 are less rigidly fixed, such that they allow a small amount of height readjustment once the shaping members and the component 300 are in contact. This would ensure a maximum contact between the shaping members 150, 250 and the component 300 in the CAF process.

As discussed, the different heights of the ends of the pins 140, 240 define a shape profile corresponding to the desired shape for shaping the component 300. The shaping members 150, 250, once attached to the pins in the die mechanism, adopt the shape profile defined by the heights of the ends of the pins 140, 240 of each pin module 130, 230.

In the next step S540, the component 300 to be formed is placed upon the upper surfaces of the shaping members 250 of the second die mechanism 210, which have now adopted the desired shape profile for shaping the component during the CAF process.

In step S550, the first die mechanism 110 is lowered to apply load to the component 300 by use of a crane, which is not part of the apparatus 100. In the present embodiment, stoppers (which are not part of the apparatus 100) are used such that the first die mechanism 110 aligns with the second die mechanism 210. Upon this application of load, the shaping members 150, 250 deform in a way that can be predicted with a combined knowledge in the material behaviour of the component 300 as well as the mechanics of beam bending, plate bending, and sheet metal forming.

When the component 300 is fully deformed, i.e., when the component 300 reaches a desired deformed shape, the die mechanisms 110, 210 are locked in place, such that the deformed component 300 and the shaping members 150, 250 are fixed in place in the subsequent step S560.

In the subsequent step S570, the apparatus 100 (including the deformed component 300) is then transported to and placed inside an oven which provides a heat treatment cycle to the apparatus 100 and the deformed component 300 at an elevated temperature for a predetermined period of time. During this heat treatment cycle process, the component 300 undergoes creep deformation as the material constituents of the component 300 precipitate, which alters the microstructure of the alloy in the component 300 and thereby strengthening it.

The parameters (e.g. temperature and duration) of the heat treatment cycle is determined according to the material of the component 300 and they are set such that the creep-age formed component 300 will have final mechanical properties that meet a desired strength specification.

After the heat treatment process in step S570, the oven is cooled in the subsequent step S580 in order to allow the apparatus 100 and the component 300 to return to room temperature.

The cooled apparatus 100 and the component 300 are then removed from the oven, and the first die mechanism 110 of the apparatus 100 is raised to a position sufficiently high (relative to the rest of the apparatus 100) so that the component 300 is allowed to springback. Springback is a result of elastic stress recovery, in which the component 300 springs back to a shape somewhere between its original shape and the shape defined by the shaping members 150, 250.

It will be appreciated that in alternative embodiments of the present invention, the method steps may be performed in a different sequence to what is described above. For example, steps S520 and S530 may be performed in reverse such that the shaping members 150, 250 are attached to the pins 140, 240 before adjusting and moving the pins 140, 240 to desired positions and heights.

In alternative embodiments, other techniques may be used to raise or lower the first die mechanism relative to the second die mechanism. Also, in alternative embodiments, the apparatus may be used without using stoppers to align the first die mechanism and the second die mechanism.

Also, it will be appreciated that in alternative embodiments, the same advantageous effect can be achieved by only rigidly fixing the heights of the pins 140 of the first die mechanism 110 in relation to the pin modules 130, once the pins and pin modules are adjusted to the required positions. At the same time, the positions of the pins 240 and pin modules 230 of the second die mechanism 210 are less rigidly fixed, such that they allow a small amount of height readjustment once the shaping members 150, 250 and the component 300 are in contact. This would achieve the same advantage of maximising contact between the component and the shaping members as described above.

According to an embodiment of the present invention, there is provided die mechanism for shaping a component during creep-age forming, the die mechanism comprising a first support member and a second support member, the first and second support members extending in a first direction; a plurality of pin modules between the first and second support members, wherein each of the plurality of pin modules extends in a second direction perpendicular to the first direction, and each pin module comprises a plurality of pins; wherein heights of ends of the plurality of pins within each of the plurality of pin modules together define a shape profile for shaping the component during creep-age forming; and wherein the plurality of pin modules are configured to be movable along the first and second support members in the first direction, and/or the plurality of pins are configured to be movable along respective pin modules in the second direction.

Some of the embodiments of the present invention provide flexibility by allowing the positions of the pins and/or pin modules to be adjusted, and/or the heights of the pins within the pin modules to be adjusted. The shaping members which are attached to the ends of the pins adopt the shape profile defined by the heights of the ends of the pins. This flexibility eliminates the need for manufacturing a unique forming tool for each shape required. Hence, the lead time is reduced, and the maintenance and manufacturing costs that are associated with additional tool designs are eliminated.

As some embodiments of the present invention have a modular design that makes use of standard parts across the entire tooling structure, the initial cost for manufacturing the apparatus is reduced. In addition, in cases where the individual parts of the die mechanism or the apparatus become damaged or worn, the replacement cost is low as the standard parts can be reproduced individually without replacing the rest of the parts of the apparatus. Moreover, as a result of the modularity, the die mechanism of some embodiments of the present invention is applicable for the production of components of variable sizes.

For some of the embodiments of the present invention, in cases where additional controlling points are required for a certain desired shape, additional pin modules and/or pins may be manufactured and added to the structure of the die mechanism according to some embodiments of the present invention, without the need to make any alterations to structures of the rest of the die mechanism. Similarly, in cases where fewer controlling points are required for a certain desired shape, the existing pin modules and/or pins may be removed from the die mechanism, thus reducing setup times as well as the associated labour and/or computational costs for positioning and adjusting the positions of the pin modules and the positions and heights of the pins. Hence, in such embodiments of the present invention, the die mechanism can be adjusted easily to compensate for a certain desired shape, without the need for re-machining.

Also, as described above, in some embodiments where shaping members are attached to the plurality of pins in the die mechanism, fewer pins can be used for defining a particular desired shape profile. Therefore, the die mechanism is more lightweight than conventional tools and can be easily transported.

It will be appreciated that the term "comprising" does not exclude other elements or steps and that the indefinite article "a" or "an" does not exclude a plurality. A single processor may fulfil the functions of several items recited in the claims. The mere fact that certain measures are recited in mutually different dependent claims does not indicate that a combination of these measures cannot be used to an advantage. Any reference signs in the claims should not be construed as limiting the scope of the claims.

Although claims have been formulated in this application to particular combinations of features, it should be understood that the scope of the disclosure of the present invention also includes any novel features or any novel combinations of features disclosed herein either explicitly or implicitly or any generalisation thereof, whether or not it relates to the same invention as presently claimed in any claim and whether or not it mitigates any or all of the same technical problems as does the parent invention. The applicants hereby give notice that new claims may be formulated to such features and/or combinations of features during the prosecution of the present application or of any further application derived therefrom.

Although a few embodiments of the present invention have been shown and described, it would be appreciated by those skilled in the art that changes may be made in these embodiments without departing from the principles of the invention, the scope of which is defined in the claims.

What is claimed is:

1. A die mechanism (110, 210) for shaping a component during creep-age forming, the die mechanism comprising:

a first support member (120-1, 220-1) and a second support member (120-2, 220-2), the first and second support members extending in a first direction;

a plurality of pin modules (130, 230) between the first and second support members, wherein each of the plurality of pin modules extends in a second direction perpendicular to the first direction, and each pin module comprises a plurality of pins;

wherein heights of ends of the plurality of pins within each of the plurality of pin modules together define a shape profile for shaping the component during creep-age forming; and wherein:

the plurality of pin modules are configured to be movable along the first and second support members in the first direction, and/or the plurality of pins are configured to be movable along respective pin modules in the second direction;

wherein the plurality of pin modules (130, 230) are configured to be removable from the first and second support members (120, 220);

wherein each of the plurality of pins of each pin module is housed in a pin housing (132, 260);

wherein each of the plurality of pin modules (130, 230) comprises a first module rack and a second module rack positioned adjacent to each other and extending in the second direction, between which the plurality of pin housings are engaged, further wherein each of the first and second module racks comprises an inward-facing guiding member arranged to guide the movement of the plurality of pin housings along the length of the pin module in the second direction.

2. The die mechanism (110, 210) according to claim 1, wherein heights of the plurality of pins within each pin module are adjustable.

3. The die mechanism (110, 210) according to claim 1, wherein the plurality of pins (140, 240) of each pin module are configured to be removable from the pin module.

4. The die mechanism (110, 210) according to claim 1, wherein the plurality of pin housings (132, 260) of each pin module are configured to be movable along a length of the pin module in the second direction.

5. The die mechanism (110, 210) according to claim 1, wherein the plurality of pin housings (132, 260) of each pin module are configured to be removable from the pin module.

6. The die mechanism (110, 210) according to claim 1, wherein each pin module comprises a shaping member (150, 250) attached to ends of the pins of the pin module, each shaping member arranged to adopt a shape profile defined by the heights of ends of the pins of the pin module.

7. The die mechanism (110, 210) according to claim 6, wherein the plurality of shaping members (150, 250) are made of a metallic material that is capable of deforming elastically to adopt the shape profile defined by the heights of ends of the pins of the pin module.

8. The die mechanism according to claim 6, wherein the shaping member of each pin module is magnetically attached to the ends of the pins of the pin module.

9. An apparatus for shaping a component during creep-age forming comprising a first die mechanism and a second die mechanism, the first die mechanism being according to claim 1, and the second die mechanism being according to claim 1, wherein the first die mechanism forms a top die of the apparatus and the second die mechanism forms a bottom die of the apparatus, and the shape profile defined by heights of ends of the plurality of pins of the first die mechanism corresponds to the shape profile defined by heights of ends of the plurality of pins of the second die mechanism.

10. The apparatus according to claim 9, wherein the top and bottom die comprises a same number of pins, and a position of each pin within the top die is vertically aligned with a position of a corresponding pin within the bottom die.

11. A method for adjusting a die mechanism of claim 1 for shaping a component for creep-age forming, the method comprising the steps of:

determining heights and positions of each of the plurality of pins within each said pin module and the position of each pin module along the first and second support members, such that the positions and heights of the plurality of pins define a shape profile defining a desired shape for shaping a component;

adjusting at least one of: the heights of each of the plurality of pins within each pin module, the positions of the plurality of pins within each pin module, and the positions of the plurality of pin modules along the first and second support members, according to the determination.

* * * * *